US006341982B1

(12) United States Patent
Sakamoto et al.

(10) Patent No.: US 6,341,982 B1
(45) Date of Patent: Jan. 29, 2002

(54) BRANCHING APPARATUS

(75) Inventors: Masami Sakamoto; Shigeki Mori, both of Toyota (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/606,405

(22) Filed: Jun. 29, 2000

(30) Foreign Application Priority Data

Jul. 14, 1999 (JP) ..... 11-200567

(51) Int. Cl.[7] ..... H01R 29/00; H01R 12/00; H01R 13/60

(52) U.S. Cl. ..... 439/537; 439/43; 437/76.1

(58) Field of Search ..... 439/537, 404, 439/189, 928, 75, 507, 511, 43, 47, 45–50, 76.2, 76.1

(56) References Cited

U.S. PATENT DOCUMENTS 3,120,584 A * 2/1964 Grunfelder et al. ..... 200/5 E
3,137,534 A * 6/1964 Schafer et al. ..... 439/48
3,151,923 A * 10/1964 Bell et al. ..... 439/48
3,196,318 A * 7/1965 Richardson ..... 361/744
3,223,957 A * 12/1965 Cannon ..... 439/46
3,627,942 A * 12/1971 Bobb ..... 200/51.07
3,771,102 A * 11/1973 Murray et al. ..... 439/189
4,127,312 A * 11/1978 Fleischhacker et al. ..... 439/40
4,938,719 A * 7/1990 Sawai et al. ..... 439/714
5,055,702 A * 10/1991 Sawai et al. ..... 439/76.2
5,683,268 A * 11/1997 Drach et al. ..... 439/404
5,722,851 A * 3/1998 Onizuka et al. ..... 439/76.2

FOREIGN PATENT DOCUMENTS

GB 2203904 A * 10/1988 ..... H01R/13/648
JP 6-54214 7/1994
JP 6-54215 7/1994
JP 6-54216 7/1994

* cited by examiner

*Primary Examiner*—Tho D. Ta
*Assistant Examiner*—James R. Harvey
(74) *Attorney, Agent, or Firm*—Morgan, Lewis & Bockius LLP

(57) ABSTRACT

A branching apparatus includes an insulating bottom plate 7, and a plurality of branch connection insulating plates 8 stacked together on the insulating bottom plate 7, and a branch connector portion 11, wires 4 passing through each of the branch connection insulating plates 8 in parallel relation to each other. The branch connector portion 11 includes an insulating housing 9, cooperating with the insulating bottom plate 7 to hold the branch connection insulating plates 8, and a plurality of penetrating connection conductors 10 supported on the insulating housing 9. One end portion of each of the penetrating connection conductors 10 passes through the branch connection insulating plates 8, and is electrically connected to the associated wires 4 to thereby effect the branch connection, and the other end portion of each penetrating connection conductor is exposed to the exterior, and serving as a connector male terminal portion 10*a*.

12 Claims, 6 Drawing Sheets

BRANCHING APPARATUS

BACKGROUND OF THE INVENTION

1. Technical Field

This invention relates to a branching apparatus for branching a plurality of juxtaposed wires, and more particularly related to a branching apparatus suitably used in a wire harness for an automobile.

2. Related Art

In a conventional branching apparatus 1 of the type described, rows of press-connecting terminals 3 are provided on one side surface of an insulating housing 2 in a manner that the row is offset from the other row, as shown in FIGS. 8 and 9. A plurality of juxtaposed wires 4 is respectively located in opposed relation to press-connecting grooves that is formed respectively in the press-connecting terminals 3.

In this condition, a press-connecting insulating cover 5 is pressed to cover all of the press-connecting terminal 3, and the wires 4 are press-fit into the press-connecting grooves, respectively. Therefore, the wires 4 are electrically connected to the terminals 3, respectively. In this condition, the press-connecting insulating cover 5 is retained on the insulating housing 2 by retaining means which includes projections 6*a* and retaining windows 6*b*.

However, this branching apparatus 1 has a problem that when expressing the connection between the press-connecting terminals 3 and the wires 4 in terms of the ratio of the terminals 3 to the wires 4, the intermediate splice absorption can be effected only in the ratio (1:1). To increase the number of branch connections, a plurality of branching apparatuses 1 must be connected to the wires 4 as shown in FIG. 9. Therefore, there have problems that the efficiency of the operation is low, that the cost is high, and that a large branching space is required.

SUMMARY OF THE INVENTION

It is an object of this invention to provide a branching apparatus in which an increased number of branching connections of wires can be obtained in a small space, and the intermediate splice can be absorbed, and a compact size of the apparatus and the cost reduction can be achieved.

According to the present invention, there is provided a branching apparatus for branching a plurality of juxtaposed wires, comprises an insulating bottom plate, and a plurality of branch connection insulating plates stacked together on the insulating bottom plate, and a branch connector portion, the wires being adapted to pass through each of the branch connection insulating plates in parallel relation to each other, the branch connector portion including an insulating housing, cooperating with the insulating bottom plate to hold the branch connection insulating plates, and a plurality of penetrating connection conductors supported on the insulating housing, one end portion of each of the penetrating connection conductors passing through the branch connection insulating plates, and being electrically connected to the associated wires, passing through the branch connection insulating plates, to thereby effect the branch connection, and the other end portion of each penetrating connection conductor being exposed to the exterior, and serving as a connector male terminal portion.

In this construction, when expressing the connection between the penetrating connection conductors and the wires in terms of the ratio of the penetrating connection conductors to the wires, (p1:n) or (n:n) is obtained.

Therefore, the number of branching connections of the wires can be increased in a small space, and besides the intermediate splice of the branch connection, in which the ratio of the penetrating connection conductors to the wires is (1:n) or (n:n), can be absorbed, and therefore the branching apparatus can be formed into a smaller size as compared with the conventional apparatus, and besides the cost can be reduced.

In the invention, each of the branch connection insulating plates includes an insulating plate body, and a plurality of wire setting grooves for respectively passing the wires therethrough in parallel relation to each other are formed in one side of the insulating plate body, and a plurality of through holes for respectively passing the penetrating connection conductors therethrough are formed in a bottom of the wire setting groove, and are arranged at predetermined intervals in a longitudinal direction, and intermediate connection terminals are set respectively at arbitrary positions in the wire setting groove, and the intermediate connection terminal includes wire connecting portions for electrical connection to the wire, passing through the wire setting groove, and a penetrating connection conductor-connecting portion for passing the associated penetrating connection conductor therethrough in electrically-connected relation thereto.

In this construction, the intermediate connection terminals, each including the wire connecting portions for electrical connection to the wire, and the penetrating connection conductor-connecting portion for passing the associated penetrating connection conductor therethrough in electrically-connected relation thereto, are incorporated in each of the branch connection insulating plates. Therefore, the wires can be easily electrically connected to the penetrating connection conductors at necessary portions thereof. In this electrical connection, the intermediate connection terminals are set respectively in the required positions, and the penetrating connection conductors are supported respectively at the required positions, and the branch portions can be easily changed by changing the set positions of the terminals and the positions of supporting of the conductors.

In the invention, the planes of those portions of the penetrating connection conductors formed in tab shape and supported on the insulating housing, passing through the branch connection insulating plates, are disposed in a direction coinciding with a direction of extending of the wire setting grooves in the branch connection insulating plates, and each of the penetrating connection conductors is bent such that the plane of the connector male terminal portion thereof, exposed to the exterior, is disposed at an angle of 90 degrees with respect to that portion of the penetrating connection conductor passing through the branch connection insulating plates.

With this construction, the planes of the connector male terminal portions of the penetrating connection conductors, exposed to the outer surface of the insulating housing, are disposed in a row. When the wires are set to be disposed perpendicularly to the planes of the connector male terminal portions, the planes of those portions of the penetrating connection conductors, passing through the penetrating connection conductor-connection portions of the respective intermediate connection terminals and passing through the branch connection insulating plates, are disposed parallel to the wires. Therefore, the width of each intermediate connection terminal is smaller as compared with the case where the planes of those portions of penetrating connection conductors, passing through branch connection insulating plates, are disposed perpendicularly to wires. As a result, the interval between the intermediate connection terminals is smaller, and therefore the size of the branching apparatus can be further reduced.

DETAILED DESCRIPTION OF PREFERRED EMBODIMENT

Figure 1:
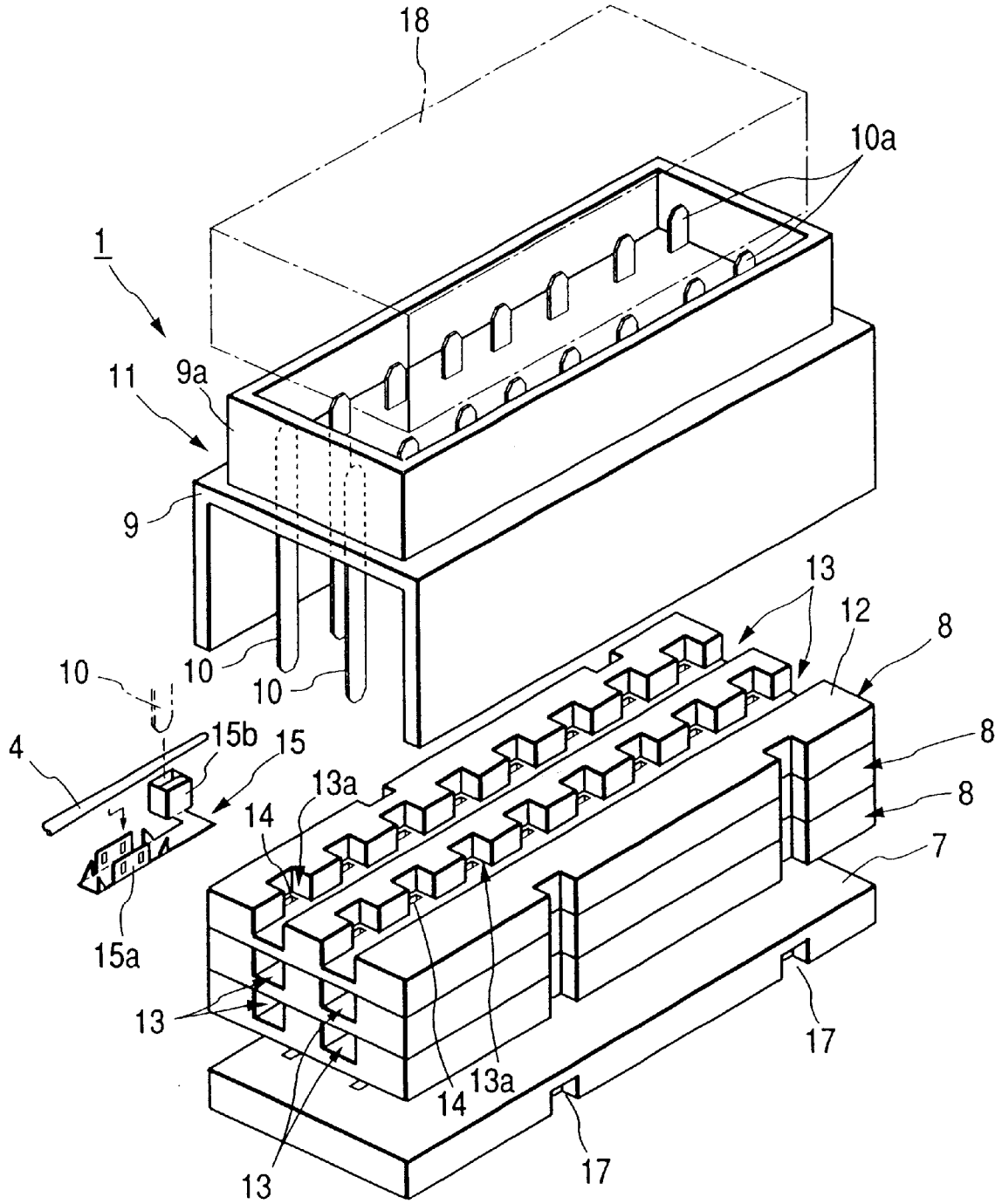
FIG. 1 is an exploded, perspective view of a first embodiment of a branching apparatus of the invention.
Figure 2:
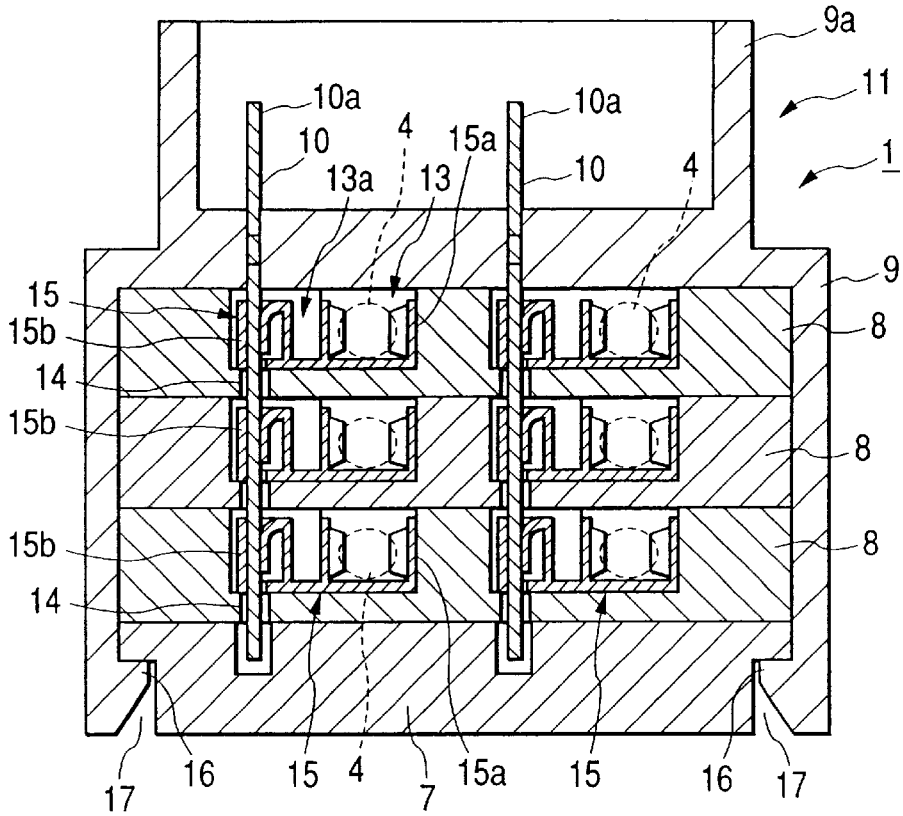
FIG. 2 is a transverse cross-sectional view of the branching apparatus of this embodiment.
Figure 3:
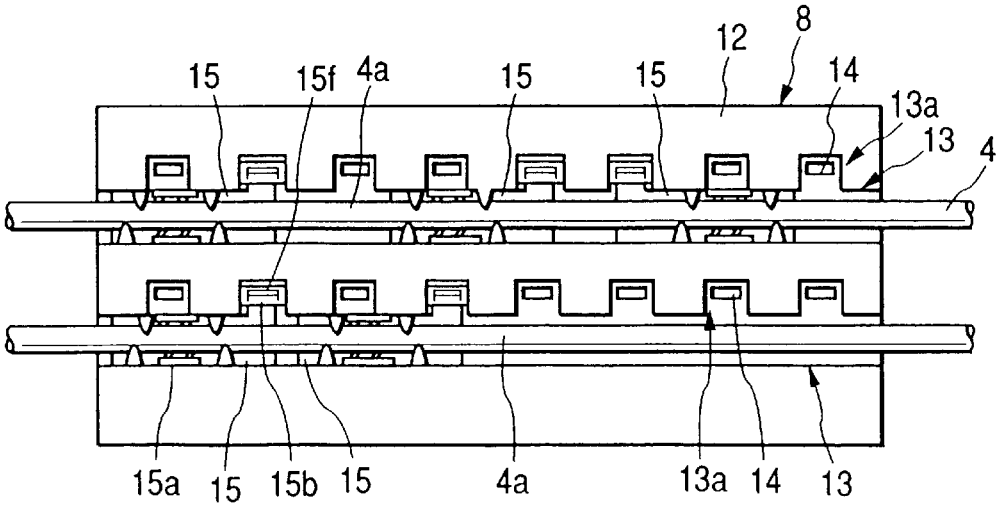
FIG. 3 is a plan view showing a condition in which wires and intermediate connection terminals are mounted or incorporated in a branch connection insulating plate used in the branching apparatus of this embodiment.
Figure 4:
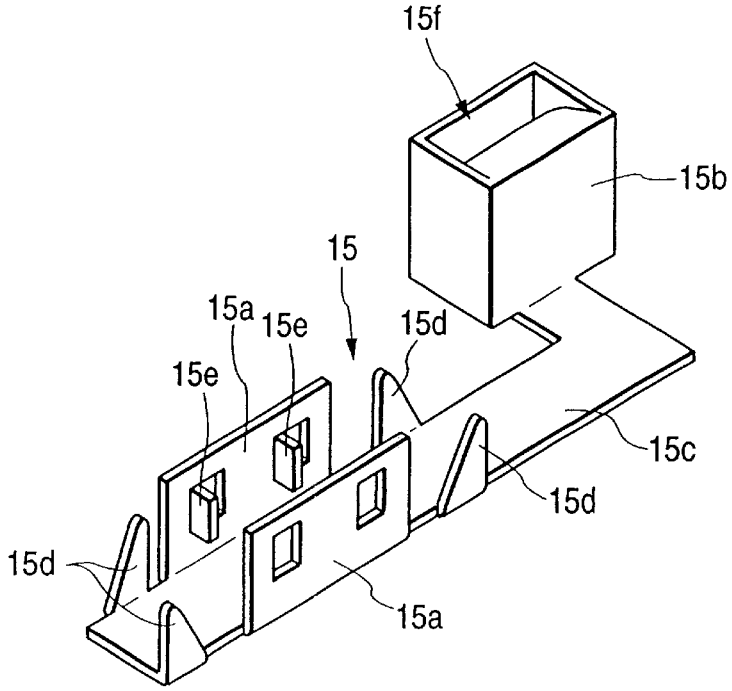
FIG. 4 is a perspective view of the intermediate connection terminal used in the branching apparatus of this embodiment.

FIGS. 1 to 4 show a first embodiment of a branching apparatus of the invention. FIG. 1 is an exploded, perspective view of the branching apparatus of this embodiment. FIG. 2 is a transverse cross-sectional view of the branching apparatus of this embodiment. FIG. 3 is a plan view showing a condition in which wires and intermediate connection terminals are mounted or incorporated in a branch connection insulating plate used in the branching apparatus of this embodiment. FIG. 4 is a perspective view of the intermediate connection terminal used in the branching apparatus of this embodiment.

The branching apparatus 1 of this embodiment includes an insulating bottom plate 7, and a plurality of branch connection insulating plates 8 stacked together on the insulating bottom plate 7. The wires 4 are adapted to pass through each of the branch connection insulating plates 8 in parallel relation to each other. The branching apparatus 1 further includes a branch connector portion 11 which includes an insulating housing 9. The insulating housing 9 cooperate with the insulating bottom plate 7 to hold the branch connection insulating plates 8. A plurality of penetrating connection conductors 10 is supported on the insulating housing 9. One end portion of each of the penetrating connection conductors 10 passes through the branch connection insulating plates 8, and are electrically connected to the associated wires 4 passing through the branch connection insulating plates 8 to thereby effect the branch connection. The other end portion of each penetrating connection conductor 10 is exposed to the exterior, and serves as a connector male terminal portion 10*a*.

Each of the branch connection insulating plates 8 has the following construction. A plurality of wire setting grooves 13 for respectively passing the wires 4 therethrough in parallel relation to each other are formed in one side (plate surface) of an insulating plate body 12. A plurality of through holes 14 for respectively passing the penetrating connection conductors 10 therethrough are formed in the bottom of the wire setting groove 13, and are arranged at predetermined intervals in the longitudinal direction. The intermediate connection terminals 15 are set respectively at arbitrary positions in the wire setting groove 13. The intermediate connection terminal 15 includes wire connecting portions 15*a* for electrical connection to the wire 4 passing through the wire setting groove 13, and a penetrating connection conductor-connecting portion 15*b* for passing the associated penetrating connection conductor 10 therethrough in electrically-connected relation thereto.

More specifically, engagement recesses 13*a* are formed in one surface side of each wire setting groove 13, and are arranged at predetermined intervals in the longitudinal direction. The engagement recesses 13*a* is open to the plate surface of the insulating plate body 12. These engagement recesses 13*a* communicate with the wire setting groove 13, and form part of the wire setting groove 13. The penetrating connection conductor-connecting portion 15*b* of the intermediate connection terminal 15 is engageable with the engagement recess 13*a*. The through hole 14 is formed in the bottom surface of the engagement recess 13*a*.

As shown in FIG. 4, the intermediate connection terminal 15 includes: a bottom plate portion 15*c* of a predetermined length which width is corresponding to the width of the wire setting groove 13; the pair of opposed wire connecting portions 15*a* extending upright respectively from opposite side edges of one end portion of this bottom plate portion 15*c*; and two pairs of opposed wire holding portions 15*d* formed on the one end portion of the bottom plate portion 15*c*, each pair of opposed wire holding portions 15*d* extending upright respectively from the opposite side edges of the bottom plate portion 15*c*. The wire 4 can be inserted between the opposed wire connecting portions 15*a* and also between each pair of opposed wire holding portions 15*d*. The penetrating connection conductor-connecting portion 15*b* of a tubular shape for passing the penetrating connection conductor 10 therethrough in electrically-connected relation thereto is formed at one side edge of the other end portion of the bottom plate portion 15*c* in offset relation thereto.

Connecting blades 15*e* are formed on an inner surface of each wire connecting portion 15*a*. When the wire 4 is inserted between the opposed wire connecting portions 15*a*, the connecting blades 15*e* bite into the wire 4 to contact a conductor of this wire 4, or are press-connected to the bare conductor 4*a*, thus making an electrical connection therebetween. Each pair of opposed wire holding portions 15*d* are bent inwardly to hold the inserted wire.

The penetrating connection conductor-connecting portion 15*b* is formed at the one side edge of the other end portion of the bottom plate portion 15*c* in offset relation thereto. The penetrating connection conductor-connecting portion 15*b* is arranged such that the penetrating connection conductor 10 passing through this connecting portion 15*b* will not interfere with the wire connecting portion 15*a* and that this connecting portion 15*b* will not interfere with the wire 4 inserted between each pair of opposed wire holding portions 15*d*. When the intermediate connection terminal 15 is set in the wire setting groove 13, the penetrating connection conductor-connecting portion 15*b* is engaged in the engagement recess 13*a* formed in the side wall of the wire setting groove 13. In this engaged condition, a tube hole 15*f* in the penetrating connection conductor-connecting portion 15*b* is aligned with the through hole 14 formed in the bottom surface of the engagement recess 13*a*.

In the intermediate connection terminal 15 of this embodiment, although the penetrating connection conductor-connecting portion 15*b* is formed at the left side edge (FIG. 4) of the bottom plate portion 15*c* in offset relation thereto, this connecting portion 15*b* can be formed at the right side edge of the bottom plate portion 15*c* in offset relation thereto though this is not shown in the drawings. Any suitable portion of the wire 4, such as an end portion thereof or a portion thereof intermediate the opposite ends thereof, can be passed through the wire setting groove 13 formed in the insulating plate body 12 of the branch connection insulating plate 8.

As described above, the branch connector portion 11 has the following structure. The insulating structure 9 cooperates with the insulating bottom plate 7 to hold the branch connection insulating plates 8. The one end portions of the penetrating connection conductors 10 supported on the insulating housing 9 pass through the branch connection insulating plates 8, and are electrically connected to the associated wires 4 passing through the branch connection insulating plates 8, to thereby effect the branch connection. The other end portions of the penetrating connection conductors 10 are exposed to the exterior, and serve as the connector male terminal portions 10*a*, respectively.

Each of the penetrating connection conductors 10 supported on the insulating housing 9 is formed in a tab shape. The each of the penetrating connection conductor 10 are incorporated in the insulating housing 9 in such a manner that the planes of at least those portions (one end portions) of these tab conductors 10 passing through the branch connection insulating plates 8 face in the same direction. In this embodiment, the planes of the connector male terminal portions (the other end portions) 10*a* of the penetrating connection conductors 10 (each including the tab conductor) also face in the same direction as that of the one end portions thereof. The connector male terminal portions 10*a* are exposed outwardly in a connector cavity portion 9*a* of the insulating housing 9 in such a manner that the planes of these terminal portions 10*a* are disposed in the direction of extending of the wires 4 passing through the branch connection insulating plates 8, that is, the planes of these terminal portions 10*a* are disposed parallel to the wires 4. A connector 18 is connected to the connector cavity portion 9*a*.

The branch connection insulating plates 8 are held between the insulating bottom plate 7 and the insulating housing 9. This condition is locked by such that engaging projections 16 formed at the lower end of the insulating housing 9 is engaged with recesses 17 formed in the insulating bottom plate 7, respectively. Each projection 16 is releasably engageable in the recess 17.

In this branching apparatus 1, when expressing the connection between the penetrating connection conductors 10 and the wires 4 in terms of the ratio of the penetrating connection conductors 10 to the wires 4, (1:n) or (m:n) is obtained. Therefore, the number of branching connections of the wires 4 can be increased in a small space. Besides, since the intermediate splice of the branch connection can be absorbed because the ratio of the penetrating connection conductors 10 to the wires 4 is (1:n) or (m:n), the branching apparatus can be formed into a smaller size as compared with the conventional apparatus, and besides the cost can be reduced.

The each of the branch connection insulating plates 8 includes the intermediate connection terminals 15 which including the wire connecting portions 15*a* for electrical connection to the wire 4, and the penetrating connection conductor-connecting portion 15*b* for passing the associated penetrating connection conductor 10 therethrough in electrically-connected relation thereto. Therefore, the wires 4 can be easily electrically connected to the penetrating connection conductors 10 at necessary portions thereof.

In this electrical connection, the branch portion of the connection can be easily changed by setting or changing the position of the penetrating connection conductor 10 supported by the insulating housing 9 or the setting position of the intermediate connection terminal 15.

Figure 5A:
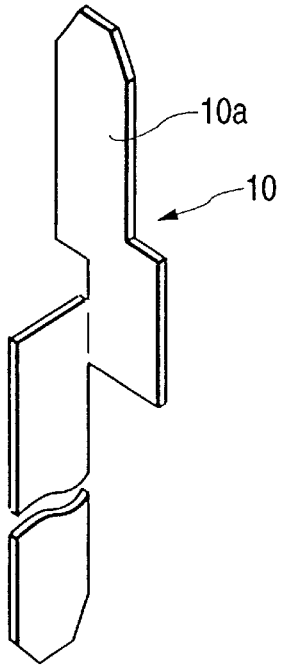
FIGS. 5A and 5B are perspective views of two kinds of penetrating connection conductors used in a second embodiment of a branching apparatus of the invention.
Figure 5B:
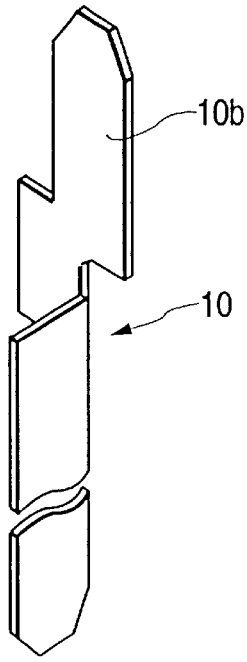
Figure 6A:
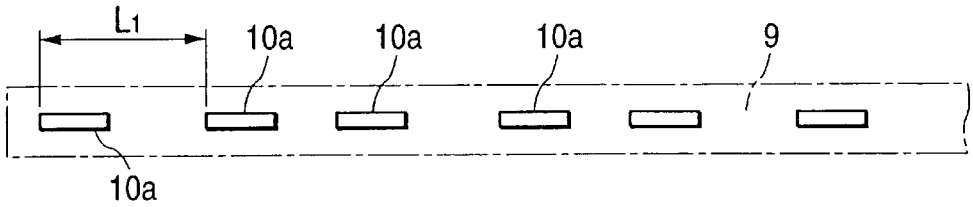
FIG. 6A is a plan view showing the arrangement of connector male terminal portions of the penetrating connection conductors in the branching apparatus of the second embodiment.
Figure 6B:
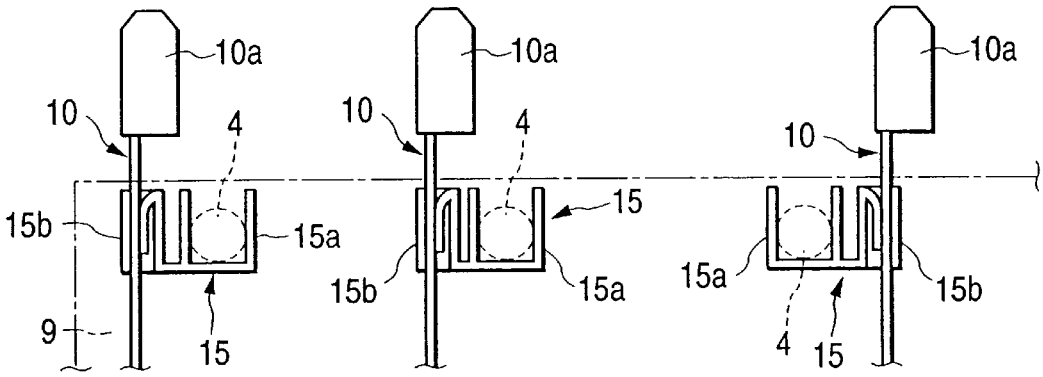
FIG. 6B is a vertical cross-sectional view showing a condition of connection between each penetrating connection conductor and the corresponding intermediate connection terminal in the branching apparatus of the second embodiment.

FIGS. 5A and 5B and FIGS. 6A and 6B show a second embodiment of a branching apparatus of the invention. FIGS. 5A and 5B are perspective views of two kinds of penetrating connection conductors 10 used in this embodiment. FIG. 6A is a plan view showing the arrangement of connector male terminal portions 10*a* of the penetrating connection conductors 10 in the branching apparatus of this embodiment. FIG. 6B is a vertical cross-sectional view showing a condition of connection between each penetrating connection conductor 10 and the corresponding intermediate connection terminal 15 in the branching apparatus 1.

In the branching apparatus 1 of this embodiment, the planes of those portions of the penetrating connection conductors 10 (each including a tab conductor and supported on the insulating housing 9), passing through the branch connection insulating plates 8, are disposed in a direction coinciding with the direction of extending of the wire setting grooves 13 in the branch connection insulating plates 8. Each penetrating connection conductor 10 is bent such that the plane of the connector male terminal portion 10*a* thereof exposed to the exterior is disposed at an angle of 90 degrees with respect to that portion thereof passing through the branch connection insulating plates 8.

With this construction, the planes of the connector male terminal portions 10*a* of the penetrating connection conductors 10 exposed to the outer surface of the insulating housing 9 are disposed in a row (see the condition of arrangement in FIG. 6A). When the wires 4 are set to be disposed perpendicularly to the planes of the connector male terminal portions 10*a*, the planes of those portions of the penetrating connection conductors 10, passing through the penetrating connection conductor-connection portions 15*b* of the respective intermediate connection terminals 15 and passing through the branch connection insulating plates 8, are disposed parallel to the wires 4. Therefore, the width of each intermediate connection terminal 15 is smaller as compared with a comparative example of FIG. 7 in which the planes of those portions of penetrating connection conductors 10, passing through branch connection insulating plates 8, are disposed perpendicularly to wires 4. As a result, the interval L1 between the intermediate connection terminals 15 is smaller than the interval L2 between intermediate connection terminals 15 (FIG. 7), and therefore the size of the branching apparatus of the invention can be further reduced.

Figure 7A:
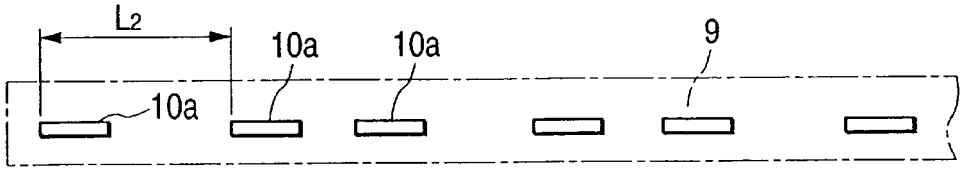
FIG. 7A is a plan view showing the arrangement of connector male terminal portions of penetrating connection conductors in a comparative branching apparatus.
Figure 7B:
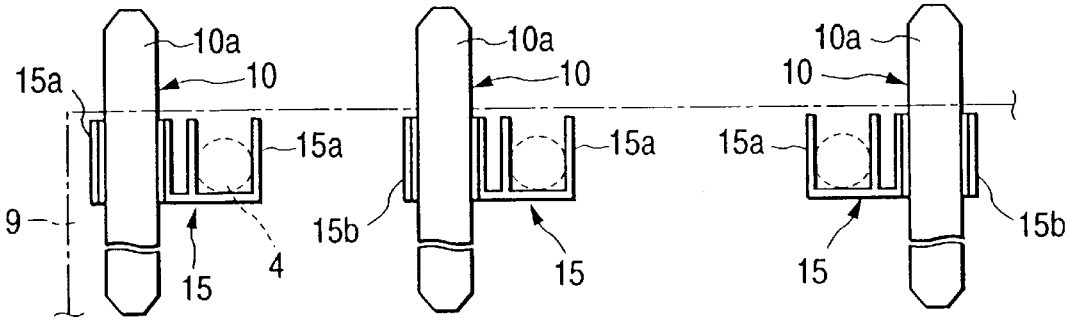
FIG. 7B is a vertical cross-sectional view showing a condition of connection between each penetrating connection conductor and the corresponding intermediate connection terminal in the comparative branching apparatus.
Figure 8:
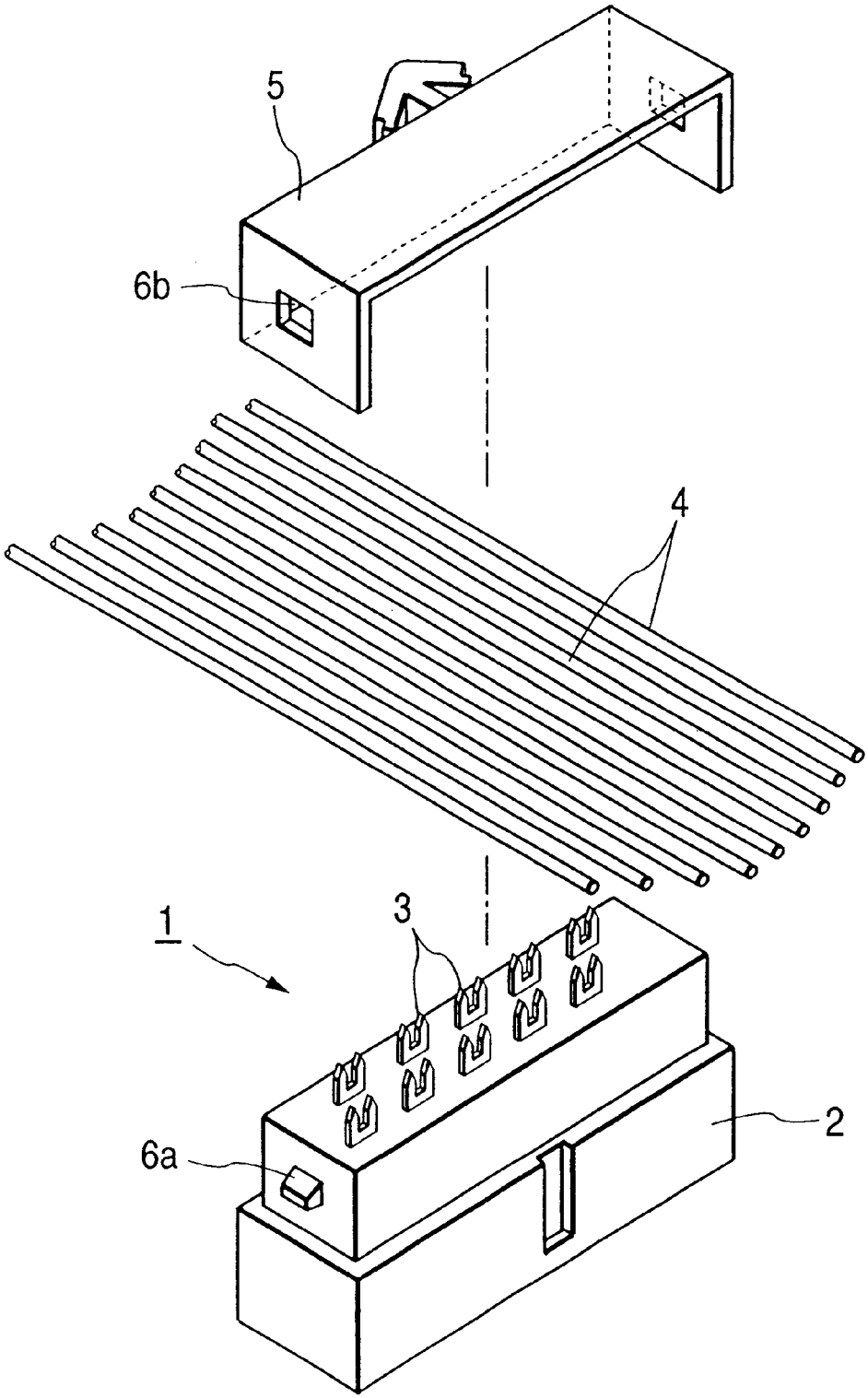
PRIOR ART FIG. 8
FIG. 8 is an exploded, perspective view of a conventional branching apparatus.
Figure 9:
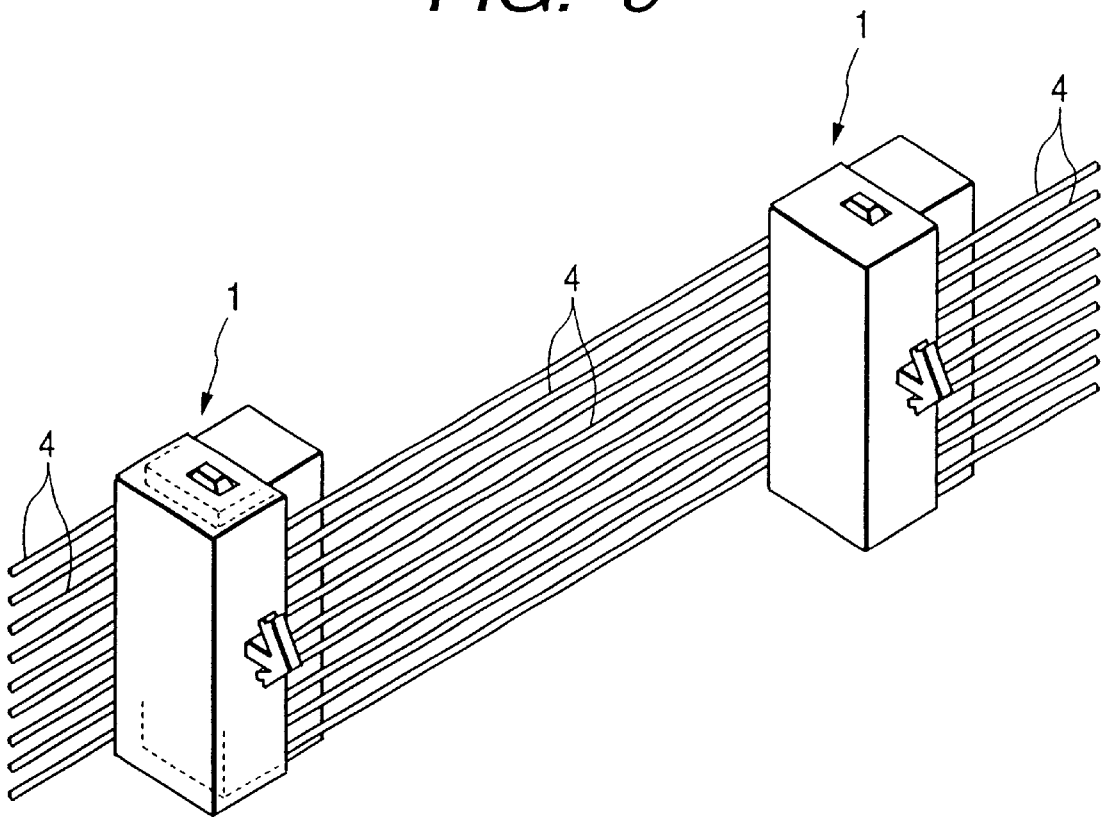
PRIOR ART FIG. 9
FIG. 9 is a perspective view showing conventional branching apparatuses.

FIGS. 7A and 7B show the comparative branching apparatus for the branching apparatus 1 of the invention, and FIG. 7A is a plan view showing the arrangement of connector male terminal portions 10*a* of the penetrating connection conductors 10 in the comparative branching apparatus, and FIG. 7B is a vertical cross-sectional view showing a condition of connection between each penetrating connection conductor 10 and the corresponding intermediate connection terminal 15 in the comparative branching apparatus.

In this comparative branching apparatus, each penetrating connection conductor 10 including a tab conductor is not bent throughout its length, and the plane of that portion of the penetrating connection conductor 10, passing through the branch connection insulating plates 8, is disposed perpendicularly to the wires 4. In this connection, the width of the intermediate connection terminal 15, having a penetrating connection conductor-connecting portion 15*b* for passing the penetrating connection conductor 10 (whose plane is disposed perpendicularly to the wires 4) therethrough, is larger than the width of the intermediate connection terminal 15 of this embodiment, and therefore the interval L2 between the intermediate connection terminals 15 is larger than the interval L1 between the intermediate connection terminals 15 in this embodiment. As a result, the comparative branching apparatus is inevitably larger in size than the branching apparatus of this embodiment.

As described above, in the invention, the number of branching connections of the wires can be increased in a small space, and besides the intermediate splice of the branch connection can be absorbed, and therefore the branching apparatus can be formed into a smaller size as compared with the conventional apparatus, and besides the cost can be reduced.

In the invention, the intermediate connection terminals, each including the wire connecting portions for electrical connection to the wire, and the penetrating connection conductor-connecting portion for passing the associated penetrating connection conductor therethrough in electrically-connected relation thereto, are incorporated in each of the branch connection insulating plates. Therefore, the wires can be easily electrically connected to the penetrating connection conductors at necessary portions thereof. In this electrical connection, the intermediate connection terminals are set respectively in the required positions, and the penetrating connection conductors are supported respectively at the required positions, and the branch portions can be easily changed by changing the set positions of the terminals and the positions of supporting of the conductors.

In the invention, the planes of the connector male terminal portions of the penetrating connection conductors, exposed to the outer surface of the insulating housing, are disposed in a row. When the wires are set to be disposed perpendicularly to the planes of the connector male terminal portions, the planes of those portions of the penetrating connection conductors, passing through the penetrating connection conductor-connection portions of the respective intermediate connection terminals and passing through the branch connection insulating plates, are disposed parallel to the wires. Therefore, the width of each intermediate connection terminal is smaller as compared with the case where the planes of those portions of penetrating connection conductors, passing through branch connection insulating plates, are disposed perpendicularly to wires. As a result, the interval between the intermediate connection terminals is smaller, and therefore the size of the branching apparatus can be further reduced, and the cost can be further reduced.

What is claimed is:

1. A branching apparatus for branching a plurality of juxtaposed wires comprising:

an insulating bottom plate;

a plurality of branch connection insulating plates stacked together on said insulating bottom plate and adapted to receive the wires passing therethrough in parallel relation to each other;

a branch connector portion including an insulating housing which cooperates with said insulating bottom plate to hold said branch connection insulating plates; and a plurality of penetrating connection conductors, each having one end passing through said branch connection insulating plates, and the other end exposed to the exterior of said branch connector portion, each of said penetrating connection conductors being electrically connectable to at least two of the wires and each of the wires being electrically connectable to at least two of said penetrating connection conductors.

2. A branching apparatus according to claim 1, wherein each of said branch connection insulating plates includes a plurality of wire setting grooves and a plurality of through holes, said wire setting grooves in each of said branch connection insulating plates are for passing corresponding respective one or more of the said wires therethrough in parallel relation to each other, said through holes in each of said branch connection insulating plates are for passing corresponding respective one or more of said penetrating connection conductors therethrough, are formed in a bottom of said wire setting groove, and are arranged at predetermined intervals in a longitudinal direction.

3. A branching apparatus according to claim 2 further comprising a plurality of intermediate connection terminals being set at predetermine position of said wire setting grooves, each of said intermediate connection terminals electrically connecting the wire and said penetrating connection conductor.

4. A branching apparatus according to claim 3, wherein said intermediate connection terminal includes wire connecting portions for electrical connection to the wire, and a penetrating connection conductor connecting portion for passing and electrical connection to the associated penetrating connection conductor therethrough.

5. A branching apparatus according to claim 3, wherein said one end is shaped having a plane substantially parallel to the longitudinal direction of said setting grooves and said other end is shaped having a plane substantially perpendicular to said direction.

6. A branching apparatus according to claim 1, wherein said penetrating connection conductors are formed of tab shape conductor.

7. A branching apparatus for branching a plurality of juxtaposed wires comprising:

a plurality of branch connection insulating plates stacked together in a stacking direction and adapted to receive the wires passing therethrough in parallel relation to each other; and a plurality of penetrating connection conductors, each having one end penetrating said branch connection insulating plates in said stacking direction;

wherein each of at least two of said penetrating connection conductors are electrically contactable to at least two of the wires and each of the wires being electrically connectable to at least two of said penetrating connection conductors.

8. A branch apparatus according to claim 7 further comprising:

an insulating bottom plate;

a branch connector portion including a insulating housing;

wherein said insulating housing cooperates with said insulating bottom plate to hold said branch connection insulating plates.

9. A branch apparatus according to claim 8, wherein the other end of each of said penetrating connection conductors is exposed to exterior of said branch connector portion.

10. A branch apparatus according to claim 7, wherein each of said branch connection insulating plates includes a plurality of wire setting grooves and a plurality of through holes, said wire setting grooves in each of said branch connection insulating plates are for passing corresponding respective one or more of the said wire therethrough in parallel relation to each other, said through holes in each of said branch connection insulating plates are for passing corresponding respective one or more said penetrating connection conductors therethrough, and are formed in a bottom of said wire setting grooves, and are arranged at predetermined intervals in a longitudinal direction.

11. A branch apparatus according to claim 10 further comprising a plurality of intermediate connection terminals being set at predetermine position of said wire setting grooves, each of said intermediate connection terminals electrically connecting the wire and said penetrating connection conductor.

12. A branch apparatus according to claim 11, wherein said intermediate connection terminal includes wire connecting portion for electrical connection to the wire, and a penetrating connection conductor connecting portion for passing and electrical connection to the associated penetrating connection conductor therethrough.

* * * * *